US008444250B2

(12) United States Patent
Igarashi et al.

(10) Patent No.: US 8,444,250 B2
(45) Date of Patent: May 21, 2013

(54) LIQUID EJECTION APPARATUS AND STORAGE MEDIUM STORING PROGRAM

(75) Inventors: Akinori Igarashi, Kasugai (JP); Shuichi Tamaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 69 days.

(21) Appl. No.: 13/249,675

(22) Filed: Sep. 30, 2011

(65) Prior Publication Data

US 2012/0162295 A1 Jun. 28, 2012

(30) Foreign Application Priority Data

Dec. 28, 2010 (JP) ..... 2010-292970

(51) Int. Cl.
*B41J 2/165* (2006.01)

(52) U.S. Cl.
CPC ..... *B41J 2/165* (2013.01); *B41J 2/16505* (2013.01)
USPC ..... 347/29; 347/23

(58) Field of Classification Search
USPC ..... 347/23, 29
See application file for complete search history.

(56) References Cited

U.S. PATENT DOCUMENTS 7,410,097 B1 8/2008 Mason et al.
2007/0285456 A1 12/2007 Takasu et al.
2009/0033707 A1 2/2009 Shimazaki
2010/0147891 A1 6/2010 Yoshihisa
2010/0171789 A1 7/2010 Mun et al.
2011/0205263 A1* 8/2011 Donahue et al. ..... 347/6

FOREIGN PATENT DOCUMENTS

JP 2005-212138 A 8/2005
JP 2006-224421 A 8/2006
JP 2008-037042 A 2/2008

OTHER PUBLICATIONS

European Patent Office, extended European Search Report for European Patent Application No. 11183315.8 (counterpart to above-captioned patent application), dated Apr. 3, 2012.

* cited by examiner

*Primary Examiner* — Julian Huffman
(74) *Attorney, Agent, or Firm* — Baker Botts L.L.P.

(57) ABSTRACT

A liquid ejection apparatus including: a liquid-ejection head for ejecting image recording liquid; a sealing mechanism for sealing an ejection space; a humid-air supply mechanism storing humidification liquid; and a liquid-discharge portion for discharging the image recording liquid, wherein a controller controls the humid-air supply mechanism to supply an air humidified by the humidification liquid into the sealed ejection space and then controls the liquid-discharge portion to discharge the image recording liquid prior to the image recording, and wherein, where a remaining amount of the humidification liquid is less than a first value, the controller executes a control such that an amount of the supplied humid air and an amount of the discharged image recording liquid are respectively made small and large as compared with in a case where the remaining amount of the humidification liquid is not smaller than the first value.

13 Claims, 11 Drawing Sheets

LIQUID EJECTION APPARATUS AND STORAGE MEDIUM STORING PROGRAM

CROSS REFERENCE TO RELATED APPLICATION

The present application claims priority from Japanese Patent Application No. 2010-292970, which was filed on Dec. 28, 2010, the disclosure of which is herein incorporated by reference in its entirety.

BACKGROUND OF THE INVENTION

1. Field of the Invention

The present invention relates to a liquid ejection apparatus configured to eject liquid droplets from ejection openings and a storage medium storing a program to be executed by the liquid ejection apparatus.

2. Description of the Related Art

There is known a technique in which an air in a cap that has sealed nozzles of a liquid-droplet ejection head is humidified using an air-conditioning device in order to prevent a viscosity of liquid in the nozzles from increasing.

SUMMARY OF THE INVENTION

In the above-described technique, when water for humidification is consumed to zero, it becomes impossible to humidify the air in the cap, making it easier for the liquid in the nozzles to be thickened (that is, the viscosity easily rises). In this case, the thickened liquid in the nozzles needs to be preliminarily ejected or forcibly discharged from the nozzles using, e.g., a pump, whereby a large amount of the liquid disadvantageously consumed.

Here, in a case where, when the air in the cap is humidified to restrain or resolve the increase in the viscosity of the liquid in the nozzles, the liquid in the nozzles cannot be sufficiently humidified to a desired viscosity for the reason that a humidity in the cap cannot be sufficiently humidified, for example, the thickened liquid in the nozzles needs to be ejected preliminarily. However, the inventor of the present invention has found by experiment that an amount of the liquid consumed in the preliminary ejection can be considerably reduced by performing both of the humidification and the preliminary ejection as compared with in the case where the increase in the viscosity of the liquid is resolved only by the preliminary ejection without humidification. Here, a reason for estimating this is explained with reference to FIG. 12. FIG. 12 shows a relationship between the humidity and the liquid viscosity in equilibrium. Where a current liquid viscosity is higher than a viscosity of the liquid in an ideal state (a desired viscosity), and a humidification is performed in order to reduce the difference in the viscosity, the viscosity difference changes exponentially with respect to a humidity difference. Thus, if the humidity difference between the current humidity and the ideal humidity can be reduced by the humidification, the viscosity difference (corresponding to the liquid amount in the preliminary ejection) can be considerably reduced.

This invention has been developed in view of the above-described situations, and it is an object of the present invention to provide a liquid ejection apparatus capable of reducing an amount of image recording liquid ejected from ejection openings in a maintenance while restraining an increase in a viscosity of the image recording liquid ejected from the ejection openings, and to provide a storage medium storing a program to be executed by the liquid ejection apparatus.

The object indicated above may be achieved according to the present invention which provides a liquid ejection apparatus comprising: a liquid-ejection head having a plurality of ejection openings and configured to eject image recording liquid through the ejection openings to record an image on a recording medium; a sealing mechanism configured to selectively establish (i) a sealed state in which an ejection space in which the ejection openings are open is sealed from an outside and (ii) an unsealed state in which the ejection space is not sealed from the outside; a humid-air supply mechanism including a humidification-liquid tank storing humidification liquid and configured to supply an air humidified by the humidification liquid into the ejection space; a humidification-liquid detecting device configured to detect a remaining amount of the humidification liquid stored in the humidification-liquid tank; a liquid-discharge portion configured to have the image recording liquid be discharged from the plurality of the ejection openings; and a controller configured to control the sealing mechanism, the humid-air supply mechanism, and the liquid-discharge portion, wherein the controller controls the humid-air supply mechanism to supply the humid air into the ejection space during the sealed state of the ejection space established by the sealing mechanism and then controls the liquid-discharge portion such that the image recording liquid is discharged from the plurality of the ejection openings prior to the ejection of the image recording liquid onto the recording medium for recording the image on the recording medium, and wherein, where the remaining amount of the humidification liquid detected by the humidification-liquid detecting device is less than a first predetermined value, the controller is configured to execute a control such that an amount of the humid air supplied into the ejection space in the sealed state and an amount of the image recording liquid discharged from the plurality of the ejection openings are respectively made small and large as compared with in a case where the remaining amount of the humidification liquid detected by the humidification-liquid detecting device is equal to or larger than the first predetermined value.

The object indicated above may also be achieved according to the present invention which provides a nonvolatile storage medium storing a program to be executed by a liquid ejection apparatus, the liquid ejection apparatus comprising: a liquid-ejection head having a plurality of ejection openings and configured to eject image recording liquid through the ejection openings to record an image on a recording medium; a sealing mechanism configured to selectively establish (i) a sealed state in which an ejection space in which the ejection openings are open is sealed from an outside and (ii) an unsealed state in which the ejection space is not sealed from the outside; a humid-air supply mechanism including a humidification-liquid tank storing humidification liquid and configured to supply an air humidified by the humidification liquid into the ejection space; a humidification-liquid detecting device configured to detect a remaining amount of the humidification liquid stored in the humidification-liquid tank; and a liquid-discharge portion configured to have the image recording liquid be discharged from the plurality of the ejection openings, the program comprising: controlling, during the sealed state of the ejection space established by the sealing mechanism, the humid-air supply mechanism to supply the humid air into the ejection space, and then controlling the liquid-discharge portion such that the image recording liquid is discharged from the plurality of the ejection openings prior to the ejection of the image recording liquid onto the recording medium for recording the image on the recording medium; and executing, where the remaining amount of the humidification liquid detected by the humidification-liquid detecting device is less than a first predetermined value, a control such that an amount of the humid air supplied into the ejection space in the sealed state and an amount of the image recording liquid discharged from the plurality of the ejection openings are respectively made small and large as compared with in a case where the remaining amount of the humidification liquid detected by the humidification-liquid detecting device is equal to or larger than the first predetermined value.

In the liquid ejection apparatus and the storage medium as described above, where the remaining amount of the humidification liquid becomes less than the first predetermined value, a consumption of the humidification liquid is reduced by decreasing the amount of the humid air to be supplied into the ejection space, and the amount of the image recording liquid to be discharged is increased. Thus, it is possible to lengthen a period in which the image recording liquid can be discharged from the ejection openings after the humidified air is supplied into the ejection space. This makes it possible to reduce the consumption of the humidification liquid while restraining the increase in viscosity of the image recording liquid in the ejection openings.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Hereinafter, there will be described an embodiment of the present invention by reference to the drawings.

Figure 1:
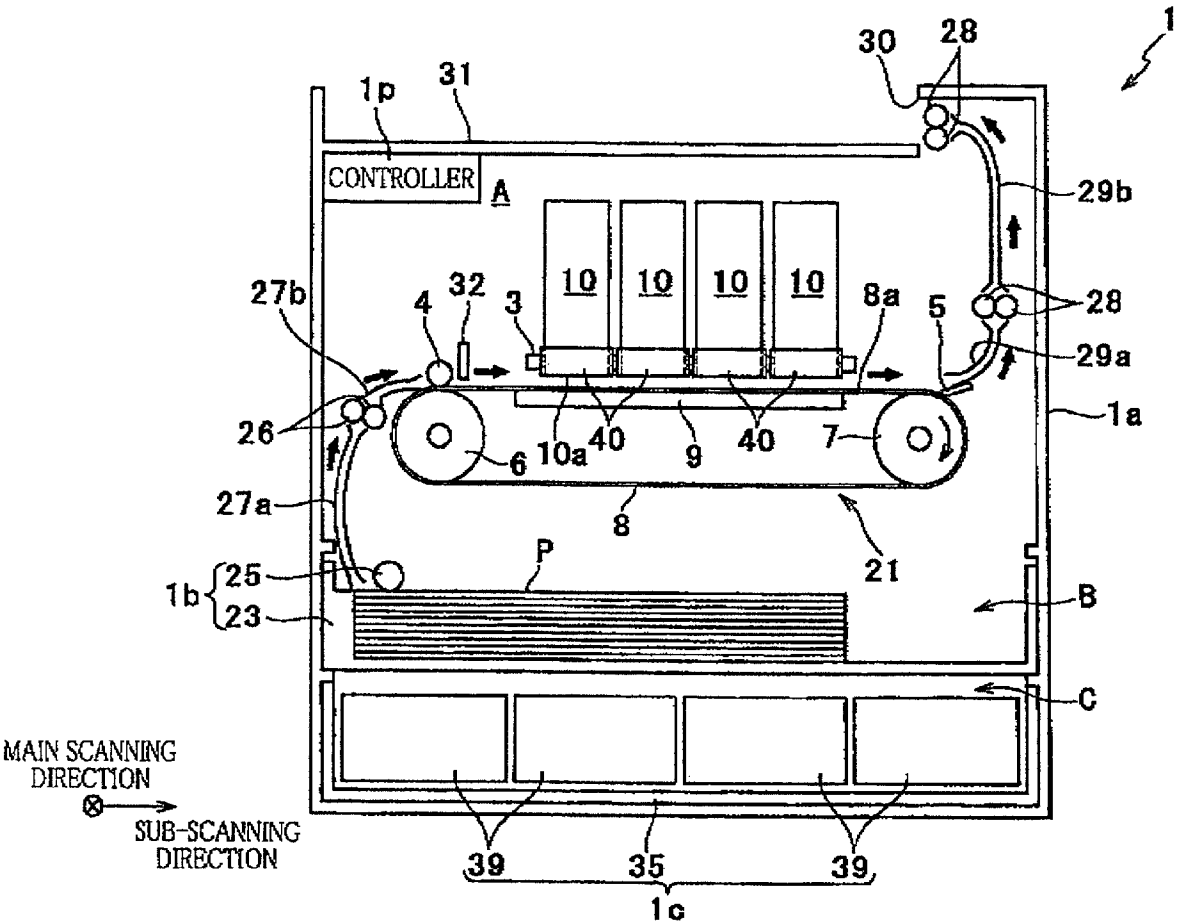
FIG. 1 is a side view generally showing an internal structure of an ink-jet printer as an embodiment of the present invention.

First, there will be explained, with reference to FIG. 1, an overall construction of an ink-jet printer 1 as an embodiment of the present invention.

The printer 1 includes a casing 1*a* having a rectangular parallelepiped shape. A sheet-discharge portion 31 is provided on a top plate of the casing 1*a*. An inner space of the casing 1*a* is divided into spaces A, B, and C in order from an upper side thereof. In the spaces A and B is formed a sheet conveyance path continuous to the sheet-discharge portion 31. In the space C are accommodated ink cartridges 39 each as an image-recording-liquid tank or an ink supply source for ink-jet heads 10 each as an example of a liquid-ejection head. The casing 1*a* is provided with a touch panel 47 as an example of a humidification input portion or an informing portion (see FIG. 8) functioning as a user interface.

In the space A, there are arranged the four heads 10, a conveyance unit 21 for conveying a sheet P as an example of a recording medium, a guide unit for guiding the sheet P, a humidifying mechanism 50 (see FIG. 5) as an example of a humid-air supply mechanism used for a humidifying maintenance, and so on. In an upper portion of the space A, there is disposed a controller 1*p* configured to control operations of components of the printer 1 to control an overall operation of the printer 1.

On the basis of image data transmitted from an external device, the controller 1*p* controls; a conveyance operation of components of the printer 1 for conveying the sheet P; an ink ejecting operation synchronized with the conveyance of the sheet P; a maintenance operation for recovering or maintaining an ejection characteristic; and so on. The maintenance operation includes flushing, purging, wiping, humidifying maintenance, and so on. The flushing is an operation for forcibly ejecting ink as image recording liquid from ejection opening(s) 14*a* by driving actuators of the head 10 on the basis of flushing data that is different from the image data, and this flushing is performed for a part or all of the ejection openings 14*a*. The purging is an operation for forcibly ejecting the ink from all of the ejection openings 14*a* by applying a pressure to the ink in the head 10 by, e.g., a pump. The wiping is an operation for wiping foreign matters on ejection faces 10*a* by a wiper after the flushing or the purging. The humidifying maintenance is an operation for supplying humid air into ejection spaces S1 (see FIG. 5) defined by respective caps 40. It is noted that the humidifying maintenance will be explained in more detail later.

The conveyance unit 21 includes (a) belt rollers 6, 7, (b) an endless conveyance belt 8 wound around the rollers 6, 7, (c) a nip roller 4 and a peeling plate 5 respectively disposed on opposite sides (outsides) of the conveyance belt 8, (d) a platen 9 disposed inside the conveyance belt 8, and so on. The belt roller 7 is a drive roller that is rotated in a clockwise direction in FIG. 1 by a conveyance motor, not shown. The conveyance belt 8 runs or is circulated along bold arrow in FIG. 1 in accordance with the rotation of the belt roller 7. The belt roller 6 is a driven roller that is rotated in the clockwise direction in FIG. 1 in accordance with the circulation of the conveyance belt 8. The nip roller 4 is disposed so as to face the belt roller 6 and press the sheet P supplied from an upstream side in a conveyance direction, onto a support face 8*a* as an outer circumferential face of the conveyance belt 8. The sheet P is then conveyed toward the belt roller 7 in accordance with the circulation of the conveyance belt 8 while being supported on the support face 8*a*. The peeling plate 5 is disposed so as to face the belt roller 7, and peels the sheet P from the support face 8*a* and then guides the sheet P toward a downstream side in the conveyance direction. The platen 9 is disposed so as to face the four heads 10 and support an upper portion of the conveyance belt 8 from an inside thereof.

Each of the heads 10 is a line head having a generally rectangular parallelepiped shape elongated in a main scanning direction in which each head 10 reciprocates. A lower face of each head 10 is the ejection face 10*a* having a multiplicity of the ejection openings 14*a* (see FIGS. 3 and 4) opened therein. In a recording operation, the four heads 10 eject inks of respective four colors, namely, black, magenta, cyan, and yellow from the respective ejection faces 10*a*. The four beads 10 are arranged in a sub-scanning direction at predetermined pitches and are supported by the casing 1*a* via a head holder 3. The bead holder 3 supports the heads 10 such that the ejection faces 10*a* face the support face Sa of the upper portion of the conveyance belt 8 with a specific space therebetween for the recording operation. On the head holder 3 are provided the circular caps 40 each for covering an outer region of the ejection face 10*a* of a corresponding one of the heads 10. Specific constructions of the heads 10 and the head holder 3 will be explained later. Here, the sub-scanning direction is a direction parallel to the conveyance direction in which the sheet P is conveyed by the conveyance unit 21, and the main scanning direction is a direction parallel to a horizontal plane and perpendicular to the sub-scanning direction.

The guide unit includes an upstream guide portion and a downstream guide portion disposed with the conveyance unit 21 interposed therebetween. The upstream guide portion includes two guides 27*a*, 27*b* and a pair of conveyance rollers 26. The guide portion connects between a sheet-supply unit 1*b* (which will be described below) and the conveyance unit 21. The downstream guide portion includes two guides 29*a*, 29*b* and two pairs of conveyance rollers 28. This guide portion connects between the conveyance unit 21 and the sheet-discharge portion 31.

In the space B is disposed the sheet-supply unit 1*b* that is mountable on and removable from the casing 1*a*. The sheet-supply unit 1*b* includes a sheet-supply tray 23 and a sheet-supply roller 25. The sheet-supply tray 23 has a box-like shape opening upward so as to accommodate various sizes of the sheet P. The sheet-supply roller 25 is rotated to supply an uppermost one of the sheets P in the sheet-supply tray 23 toward the upstream guide portion.

As described above, in the spaces A, B is formed the sheet conveyance path extending from the sheet-supply unit 1*b* to the sheet-discharge portion 31 via the conveyance unit 21. On the basis of a recording command transmitted from the external device, the controller 1*p* drives a plurality of motors such as a sheet-supply motor, not shown, for the sheet-supply roller 25, a sheet-conveyance motor, not shown, for the conveyance rollers of each of the upstream and downstream guide portions, the above-described conveyance motor, and the like. The sheet P supplied from the sheet-supply tray 23 is supplied to the conveyance unit 21 by the conveyance rollers 26. When the sheet P passes through positions just under the heads 10 in the sub-scanning direction, the heads 10 eject the inks of the respective four colors in order from the respective ejection faces 10*a*, to record or form a color image on the sheet P. The ink ejection is performed on the basis of a detection signal outputted from a sheet sensor 32. The sheet P is then peeled by the peeling plate 5 and conveyed upward by the conveyance rollers 28. The sheet P is then discharged onto the sheet-discharge portion 31 through an opening 30.

In the space C, an ink unit 1*c* is disposed so as to be mountable on and removable from the casing 1*a*. The ink unit 1*c* includes: a cartridge tray 35; the four cartridges 39 accommodated in the fray 35 side by side; and a water tank 54 (see FIG. 5) as an example of a humidification-liquid tank. The inks stored in the respective cartridges 39 are to be supplied to the respective heads 10 via respective ink tubes, not shown. To each of the cartridges 39, there is attached an ink-remaining-amount sensor 39*a* (see FIG. 8) as an example of an image-recording-liquid detecting device for detecting a remaining amount of the ink stored in the cartridge 39.

There will be next explained the construction of each head 10 with reference to FIGS. 2-4 and 7 in detail. It is noted that, in FIG. 3, pressure chambers 16 and apertures 15 are illustrated by solid lines for easier understanding purposes though these elements are located under actuator units 17 and thus should be illustrated by broken lines. It is further noted that since the four heads 10 have the same construction, the following explanation will be given for one of the heads 10 for the sake of simplicity.

The head 10 includes a reservoir unit 11, a channel unit 12 (see FIG. 7), the eight actuator units 17 each as an example of a liquid-discharge portion (see FIG. 2) fixed to an upper face 12*x* of the channel unit 12, a Flexible Printed Circuit (the FPC) 19 (see FIG. 4) bonded to each of the actuator units 17 and so on which are stacked on one another in a vertical direction. In the reservoir unit 11 are formed ink channels including a reservoir that temporarily stores the ink supplied from the cartridge 39 (see FIG. 1). In the channel unit 12 are formed ink channels each extending from a corresponding one of openings 12*y* of the upper face 12*x* (see FIG. 2) of the channel unit 12 to a corresponding one of the ejection openings 14*a* formed in a lower face of the channel unit 12 (i.e., the ejection face 10*a*). The actuator units 17 include piezoelectric actuators for the respective ejection openings 14*a*.

Protruding portions and recessed portions are formed on and in a lower face of the reservoir unit 11. The protruding portions are bonded to the upper face 12*x* of the channel unit 12 at areas on which no actuator units 17 are disposed (noted that the areas include the openings 12*y* and are enclosed with two-dot chain lines in FIG. 2). A distal end face of each of the protruding portions has an opening connected to the reservoir and facing a corresponding one of the openings 12*y* of the channel unit 12. As a result, the reservoir and individual ink channels 14 are communicated with each other via the above-described openings. The recessed portions face the upper face 12*x* of the channel unit 12, faces of the respective actuator units 17, and a face of the the FPC 19 with slight spaces formed therebetween.

Figure 2:
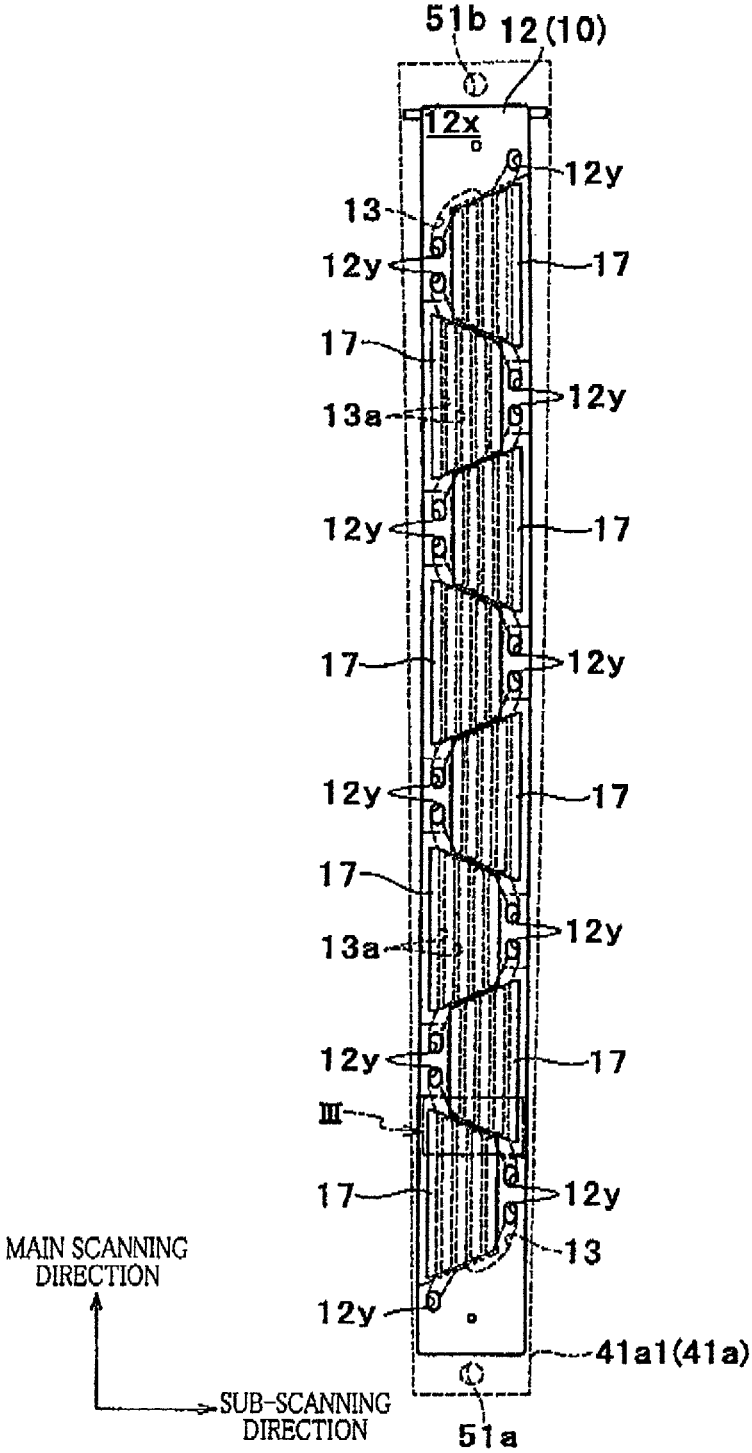
FIG. 2 is a plan view showing a channel unit and actuator units of each ink-jet head of the printer in FIG. 1.
Figure 3:
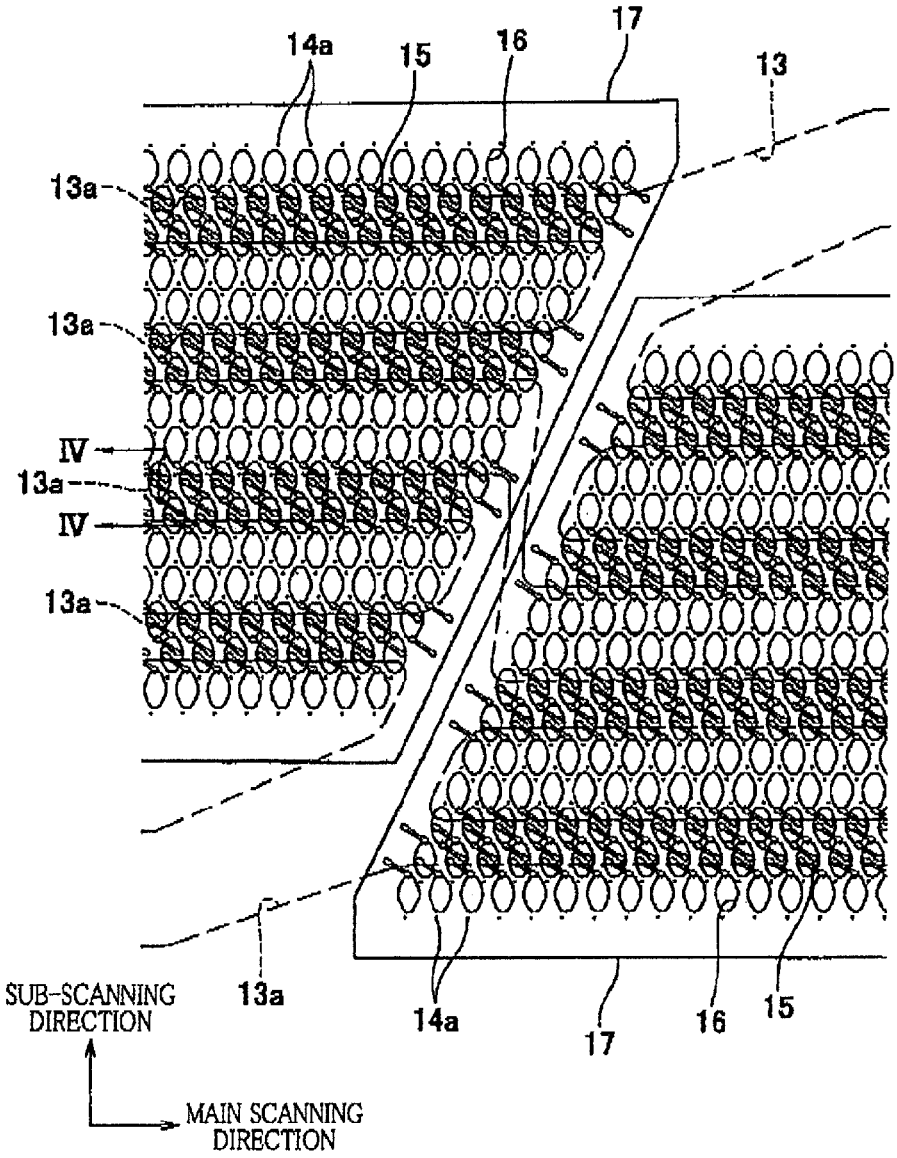
FIG. 3 is an enlarged view showing an area III enclosed by one-dot chain line in FIG. 2.
Figure 4:
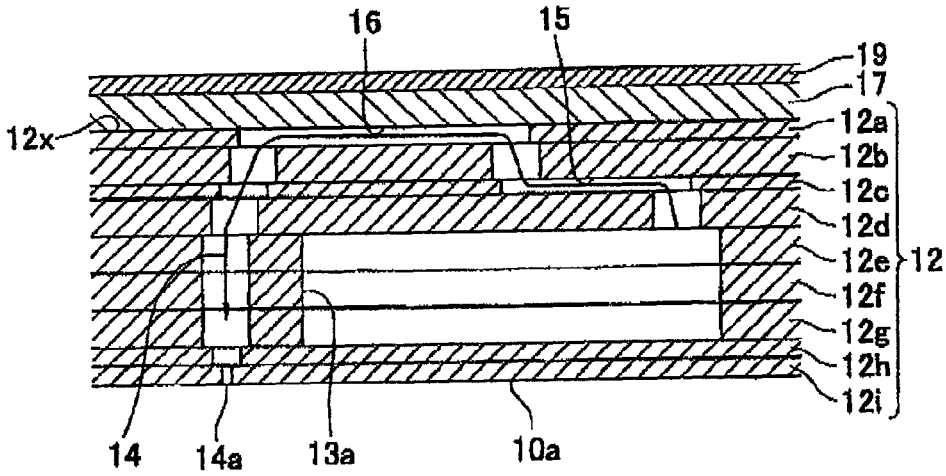
FIG. 4 is a partial cross-sectional view taken along line IV-IV in FIG. 3.

The channel unit 12 is a stacked body constituted by nine metal rectangular plates 12*a*-12*i* (see FIG. 4) having generally the same size and bonded to one another. As shown in FIGS. 2-4, the channel unit 12 includes: manifold channels 13 each having a corresponding one of the openings 12*y* as one end; sub-manifold channels 13*a* each branched from a corresponding one of the manifold channels 13; the individual ink channels 14 respectively extending from outlets of the sub-manifold channels 13*a* to the ejection openings 14*a* via the pressure chambers 16. As shown in FIG. 4, the individual channel 14 is formed for each ejection opening 14*a* so as to have the aperture 15 functioning as a restrictor for adjusting a channel resistance. Generally rhombic openings for respectively exposing the pressure chambers 16 are formed in matrix in areas on the upper face 12*x* to which the actuator units 17 are respectively bonded. The ejection openings 14*a* are formed in matrix in the same pattern as the pressure chambers 16, in the lower face (i.e., the ejection face 10*a*) at areas opposed to the areas on the upper face 12*x* to which the actuator units 17 are respectively bonded.

As shown in FIG. 2, the actuator units 17 each having a trapezoid shape are arranged on the upper face 12*x* in two arrays in a staggered configuration. As shown in FIG. 3, each of the actuator units 17 covers the multiplicity of the pressure chambers 16 formed under the actuator unit 17. Though not shown, each of the actuator units 17 includes: a plurality of piezoelectric layers expanding over the multiplicity of the pressure chambers 16; and electrodes interposing the piezoelectric layers in a thickness direction of the actuator units 17.

The electrodes include: a common electrode common for the pressure chambers 16 and individual electrodes provided for the respective pressure chambers 16. The individual electrodes are formed on a face of an uppermost one of the piezoelectric layers.

The the FPC 19 has wirings corresponding to the respective electrodes of the actuator units 17, and a driver IC, not shown, is mounted on the wirings. The the FPC 19 is fixed at one end thereof to the actuator units 17 and at the other end to a control board, not shown, of the head 10, which is disposed on an upper side of the reservoir unit 11. Under the control of the controller 1*p* (see FIG. 1), the the FPC 19 sends the driver IC various drive signals outputted from the control board and sends the actuator units 17 signals produced by the driver IC.

Figure 5:
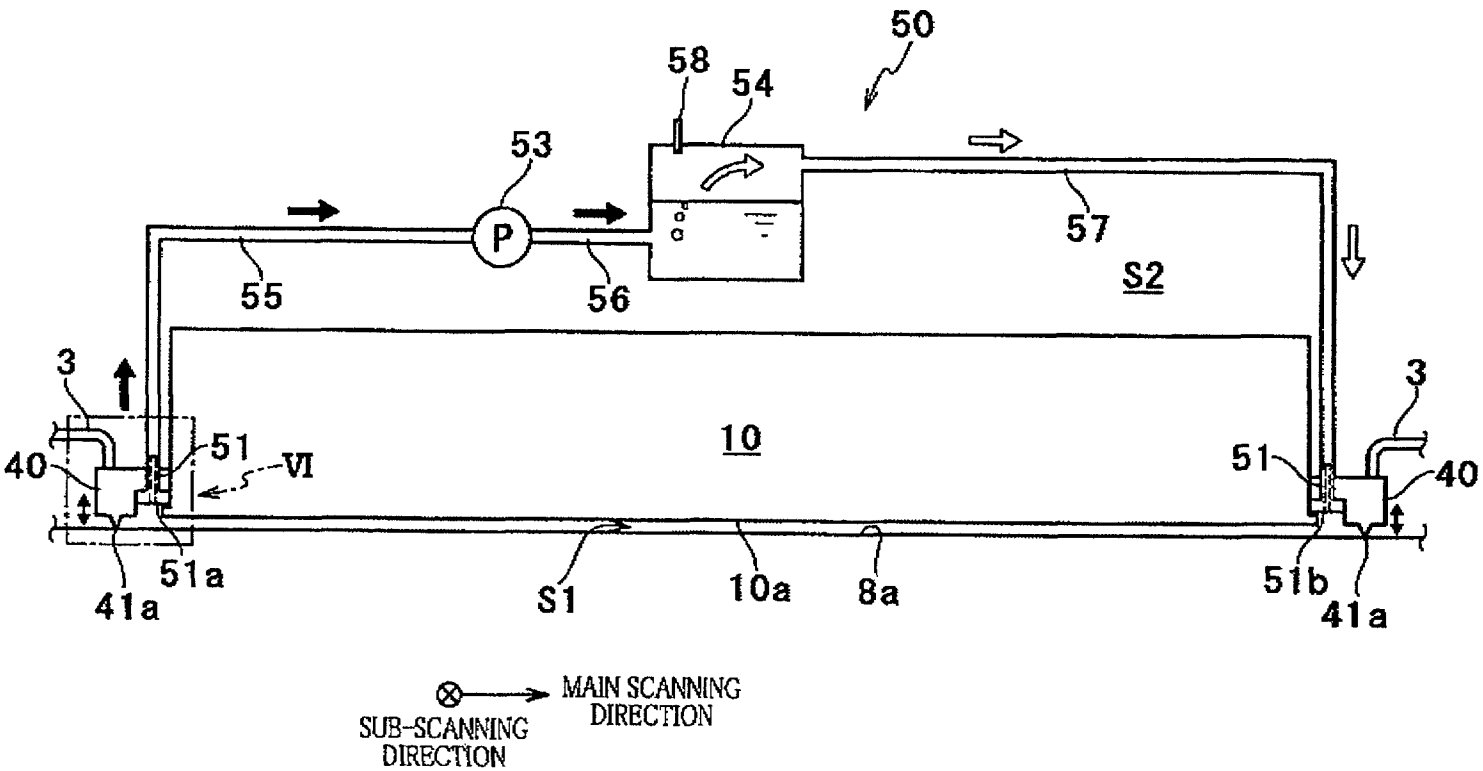
FIG. 5 is a schematic view showing a head holder and a humidifying mechanism of the printer in FIG. 1.
Figure 6:
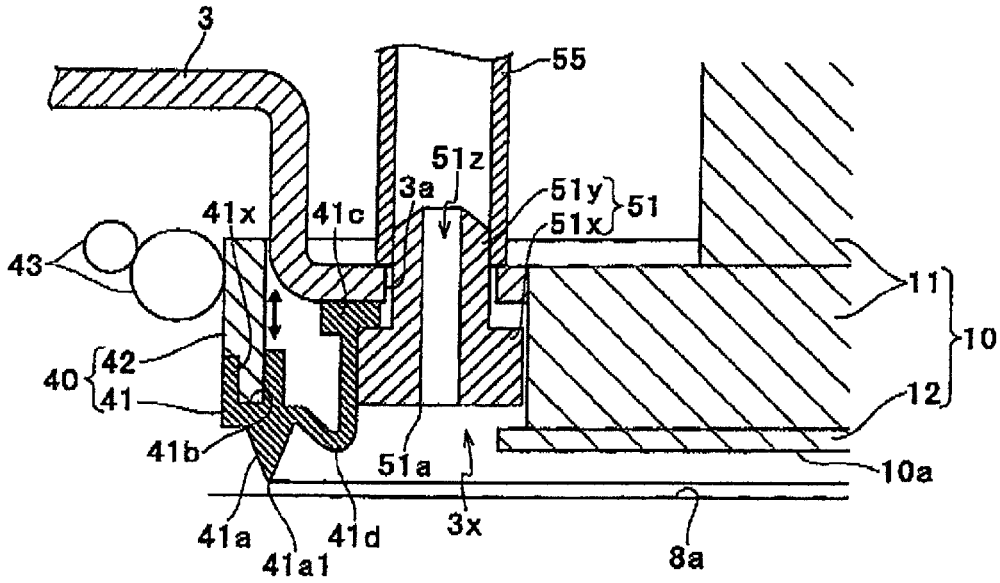
FIG. 6 is a partial cross-sectional view showing an area VI enclosed with a one-dot chain line in FIG. 5.

There will be next explained a construction of the head holder 3 with reference to FIGS. 2, 5, and 6.

The bead holder 3 is a frame made of a metal, for example. For each head 10, the caps 40 and pairs of joints 51 are mounted on the head holder. Recessed portions 3*x* are formed in a face of the head holder 3. The pair of joints 51 are disposed in the respective recessed portions 3*x*.

As shown in FIG. 5, each pair of the joints 51 respectively constitute one and the other ends of the circulation channel of the humidifying mechanism 50 and are respectively disposed near one and the other ends of a corresponding one of the heads 10 in the main scanning direction. In the humidifying maintenance, an air is sucked through an opening 51*a* formed in a lower face of one of the pair of the joints 51 (the left joint 51 in FIG. 5), and a humid air is supplied through an opening 51*b* formed in a lower face of the other of the pair of the joints 51.

As shown in FIG. 6, each of the joints 51 has a generally cylindrical shape and has a basal end portion 51*x* and a distal end portion 51*y* extending from the basal end portion 51*x*. A hollow space 51*z* is formed through the basal end portion 51*x* and the distal end portion 51*y* in the vertical direction. The basal end portion 51*x* and the distal end portion 51*y* have different outside diameters from each other, specifically, the basal end portion 51*x* has a greater outside diameter than that of the distal end portion 51*y*. The hollow space 51*z* has a uniform diameter along the vertical direction. A diameter of an upper end portion of the distal end portion 51*y* decreases from a lower side to an upper side thereof, that is, the upper end portion of the distal end portion 51*y* is tapered. This facilitates a connection of one end of a tube 55 or 57 to the distal end portion 51*y*.

The joints 51 are fixed to the head holder 3 in a state in which the distal end portions 51*y* are inserter and fitted in respective through holes 3*a* of the head holder 3. The through holes 3*a* are formed at respective positions at which the joints 51 are disposed on the head holder 3, that is, the through holes 3*a* are respectively formed near one and the other ends of the head 10 in the main scanning direction. The outside diameter of the distal end portion 51*y* is one size smaller than that of the through hole 3*a*. Thus, a small space is formed between an outer circumferential face of the distal end portion 51*y* and a wall face defining the through hole 3*a* of the head holder 3. This space is sealed by, e.g., a sealing material when the joint 51 is fixed to the head holder 3.

Each cap 40 has a circular shape in plan view for enclosing an outer peripheral area of the ejection face 10*a* of the corresponding head 10. The cap includes: an elastic member 41 supported by the head holder 3 via a fixed portion 41*c*; and a movable member 42 movable upward and downward.

The elastic member 41 is formed of an elastic material such as a rubber and includes (a) a base portion 41*x*, (b) a projecting portion 41*a* projecting downward from a lower face of the base portion 41*x* so as to have an inverted triangle shape in cross section, (c) the fixed portion 41*c* having a T-shape in cross section and fixed to the head holder 3, and (e) a connecting portion 41*d* for connecting the base portion 41*x* and the fixed portion 41*c* to each other. The elastic member 41 has a circular shape in plan view for enclosing the outer peripheral area of the ejection face 10*a*. An upper end portion of the fixed portion 41*c* is fixed to the head holder 3 by adhesive, for example. The fixed pardon 41*c* is sandwiched near the through hole 3*a* between the head holder 3 and the basal end portion 51*x* of the joint 51. The connecting portion 41*d* extends from a lower end of the fixed portion 41*c* and curves to an outside in a direction away from the ejection face 10*a* in plan view, so as to be connected to a lower end of the base portion 41*x*. The connecting portion 41*d* is deformable so as to be deformed according to the upward and downward movement of the movable member 42. An upper face of the base portion 41*x* has a recessed portion 41*b* that is fitted on a lower end of the movable member 42.

The movable member 42 is formed of a rigid material and has a circular shape in plan view for enclosing an outer peripheral area of the ejection face 10*a* of the head 10 like the elastic member 41. The movable member 42 is supported by the head holder 3 via the elastic member 41 so as to be movable relative to the head holder 3 in the vertical direction. Specifically, the movable member 42 is connected to a plurality of gears 43 and moved upward and downward by the gears 43 rotated by a drive power outputted from an up-down motor 44 (see FIG. 8) under the control of the controller 1*p*. In this upward and downward movement of the movable member 42, the base portion 41*x* is also moved upward and downward with the movable member 42 because the lower end of the movable member 42 is fitted in the recessed portion 41*b* of the elastic member 41. When the movable member 42 is moved upward and downward, the projecting portion 41*a* is also moved upward and downward in the state in which the fixed portion 41*c* is fixed to the head holder 3. As a result, a position of a distal end 41*a*1 of the projecting portion 41*a* relative to the ejection face 10*a* in the vertical direction is changed.

According to the upward and downward movement of the movable member 42, the projecting portion 41*a* is selectively positioned at a contact position (see FIG. 5) at which the distal end 41*a*1 is held in contact with the support face 8*a* of the conveyance belt 8 and at a distant position (see FIG. 6) at which the distal end 41*a*1 is distant from the support face 8*a* of the conveyance belt 8. As shown in FIG. 5, when the projecting portion 41*a* is positioned at the contact position, a capped state (sealed state) is established in which the ejection space S1 formed between the ejection face 10*a* and the support face 8*a* is isolated from or does not communicate with an outside space S2. As shown in FIG. 6, when the projecting portion 41*a* is positioned at the distant position, an uncapped state (unsealed state) is established in which the ejection space S1 communicates with the outside space S2. It is noted that the ejection space S1 is a space facing the ejection face 10*a*, in other words, the ejection space S1 is the space in which the plurality of the ejection openings 14*a* formed in the ejection face 10*a* are opened, in other words, the ejection space S1 is the space to which the ink is ejected from the plurality of the ejection openings 14*a*.

The projecting portion 41*a* is distant from the ejection face 10*a* over an entire perimeter of the ejection face 10*a* (i.e., the lower face of the head 10 in FIG. 2) in plan view. Further, the projecting portion 41*a* has a generally rectangular shape in plan view so as to enclose the ejection face 10*a*. In view of the above, each cap 40 and the support face 8*a* are an example of a sealing mechanism.

Figure 7:
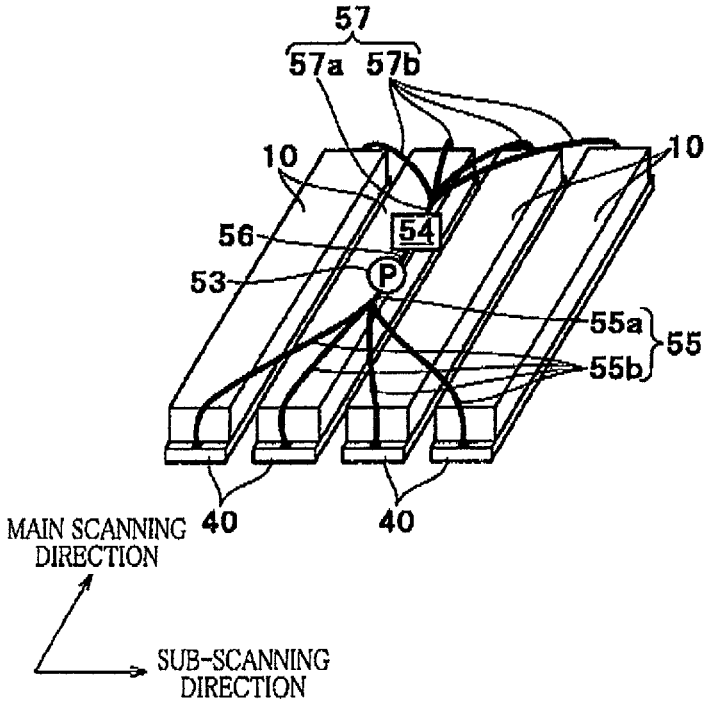
FIG. 7 is a schematic view showing connection between all the heads of the printer in FIG. 1 and a humidifying mechanism.

There will be next explained a construction of the humidifying mechanism 50 with reference to FIGS. 5 and 7.

As shown in FIG. 5, the humidifying mechanism 50 includes the joints 51, the tubes 55, 57, a tube 56, a pump 53, and the water tank 54. Although the pair of the joints 51 are provided for each head 10, as shown in FIG. 7, the single pump 53 and the single water tank 54 are provided in the printer 1, that is, the single pump 53 and the single tank 54 are provided for the four heads 10 (see FIG. 7). The tube 55 includes a main portion 55*a* common for the four heads 10 and four branch portions 55*b* branched from the main portion 55*a* and each extending to a corresponding one of the joints 51. Likewise, the tube 57 includes a main portion 57*a* common for the four heads 10 and four branch portions 57*b* branched from the main portion 57*a* and each extending to a corresponding one of the joints 51.

One ends of the tube 55 (distal ends of the respective branch portions 55*b*) are respectively fitted on the distal end portions 51*y* of the joints 51 (left joints 51 in FIG. 5) provided on the respective heads 10. The other end of the tube 55 (an end of the main portion 55*a* opposite to the branch portions 55*b*) is connected to the pump 53. That is, the tube 55 communicably connects the pump 53 and the hollow space 51*z* of one of each pair of the joints 51 to each other. The tube 56 communicably connects the pump 53 and the water tank 54 to each other. One ends of the tube 57 (distal ends of the respective branch portions 57*b*) are respectively fitted on the distal end portions 51*y* of the joints 51 (right joints 51 in FIG. 5) provided on the respective heads 10. The other end of the tube 57 (an end of the main portion 57*a* opposite to the branch portions 57*b*) is connected to the water tank 54. That is, the tube 57 communicably connects the water tank 54 and the hollow space 51*z* of the other of each pair of the joints 51 to each other.

The water tank 54 stores water as an example of humidification liquid in its lower space and stores in its upper space the humid air humidified by the water stored in the lower space. The tube 56 is connected to a side face of the water tank 54 below a water surface (i.e., an upper surface of the water), that is, the tube 56 is connected to the lower space of the water tank 54. The tube 57 is connected to another side face of the water tank 54 above the water surface, that is, the tube 57 communicates with the upper space of the water tank 54. It is noted that a check valve, not shown, is provided on the tube 56 for preventing the water in the water tank 54 from flowing into the pump 53, resulting in that the air flows only in a direction indicated by arrows hi FIG. 5. Further, a water-remaining-amount sensor 58 as an example of a humidification-liquid detecting device is provided for detecting a remaining amount of the water stored in the water tank 54. When the water-remaining-amount sensor 58 has detected that the remaining amount of the water stored in the water tank 54 is less than a first predetermined amount or value (which will be described below), such information is displayed on the touch panel 47.

Figure 8:
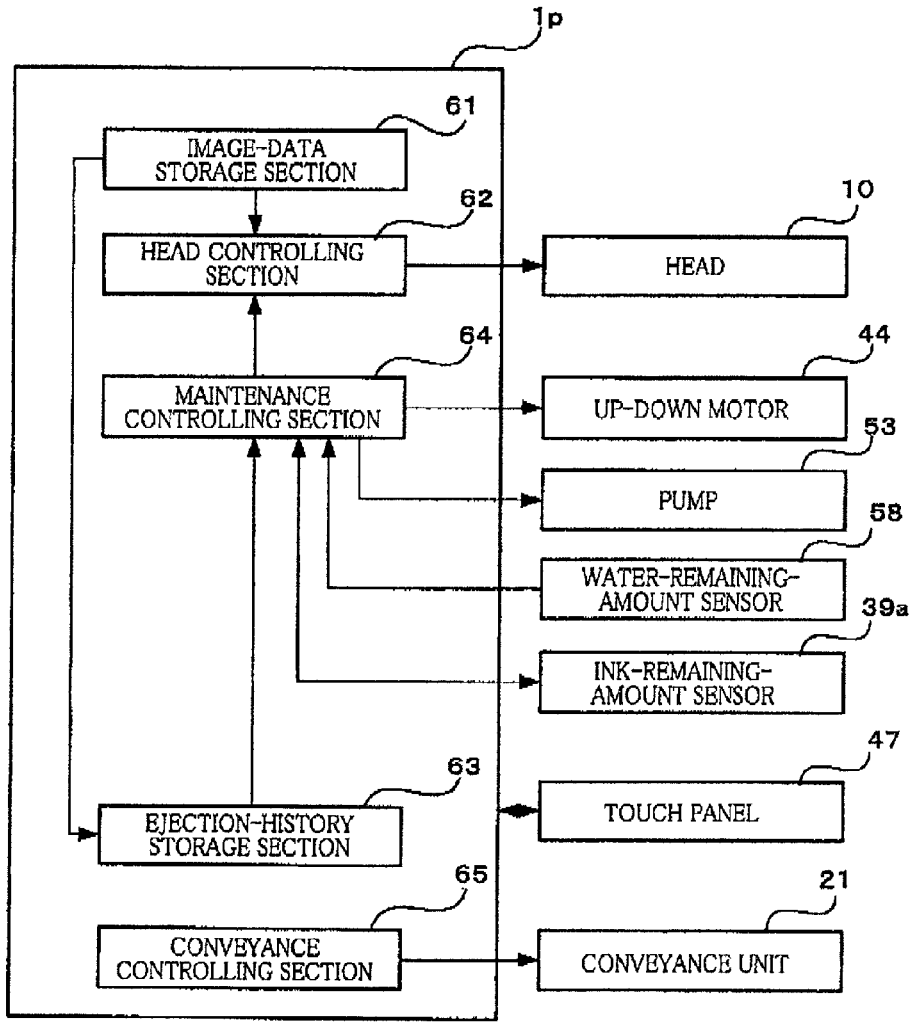
FIG. 8 is a block diagram showing functions of a controller of the printer in FIG. 1.

There will be next explained the controller 1*p*. The controller 1*p* includes a Central Processing Unit (CPU); a nonvolatile memory for rewritably storing programs executed by the CPU and data used for these programs; and a Random Access Memory (RAM) for temporarily storing the date upon the execution of the program. The controller 100 includes various functional sections which are constituted by cooperation of these hardwares and softwares in the nonvolatile memory with each other. These programs are stored in various storage media such as a flexible disc, a CD-ROM, and a memory card, and installed from these storage medium into the nonvolatile memory. It is noted that control programs stored in the storage medium may be programs to be executed directly by the CPU and may be programs that become executable by being installed to the nonvolatile memory. Further, the control programs may be encrypted and/or compressed. As shown in FIG. 8, the controller 1*p* includes an image-data storage section 61, a head controlling section 62, an ejection-history storage section 63, a maintenance controlling section 64, and a conveyance controlling section 65.

The image-data storage section 61 stores the image data based on which an image is recorded on the sheet P. The conveyance controlling section 65 is configured to control the conveyance unit 21 such that the sheet P is conveyed through the sheet conveyance path at a predetermined speed. The head controlling section 62 is configured to control the heads 10 such that the image is recorded on the sheet P conveyed by the conveyance unit 21 on the basis of the image data stored in the image-data storage section 61, and such that the flushing is performed in the maintenance operation.

The ejection-history storage section 63 stores, as an ejection history, a time elapsed from the last ejection of the ink for each of the ejection openings 14*a*.

The maintenance controlling section 64 is configured to control the pump 53 of the humidifying mechanism 50 and the up-down motor 44 for moving upward and downward the movable members 42 (the distal ends 41*a*1 of the respective projecting portions 41*a*) in order to perform the humidifying maintenance. Further, the maintenance controlling section 64 is configured to control the heads 10 via the head controlling section 62. The humidifying maintenance is an operation in which the flushing is performed after the ejection spaces S1 have been humidified in the capped state, and the humidifying maintenance is started when a predetermined length of time has passed from the last recording. It is noted that the heads 10, the head holder 3, and the conveyance belt 8 are located at their respective predetermined positions during operations of the humidifying maintenance which will be described below. The head holder 3 is positioned while holding the heads 10 such that a predetermined space suitable for the recording is formed between the ejection faces 10*a* and the support face 8*a*.

In the humidifying maintenance, the maintenance controlling section 64 initially rotates the gears 43 to lower the movable member 42. The projecting portion 41*a* is located at the distant position (see FIG. 6) in the recording but moved to the contact position (see FIG. 5) according to the downward movement of the movable member 42. As a result, the ejection spaces S1 are sealed to establish the capped state. It is noted that, in a standby state or a sleep (suspended) state other than the recording, the maintenance controlling section 64 moves the projecting portion 41*a* to the contact position to establish the capped state.

The maintenance controlling section 64 then drives the pump 53 to suck the air in each ejection space S1 through the opening 51*a* of the corresponding joint 51. In this operation, the air sucked through the opening 51*a* is moved to the pump 53 through the hollow space 51*z* of the joint 51 and the tube 55 and then to the water tank 54 through the tube 56. The air is supplied to the lower space of the water tank 54 (on a lower side of the water surface). The air humidified by the water in the water tank 54 (the humid air) is discharged from the upper space of the water tank 54. At this time, the humidity of the air discharged from the upper space of the water tank 54 is a value near 100%. This humid air is supplied to the ejection spaces S1 from the opening 51*b* of the joint 51 through the tube 57. In FIG. 5, boldface arrows indicate the flow of the air before the humidification, and outline (white) arrows indicate the flow of the air after the humidification. In response to the above-described driving of the pump 53, the maintenance controlling section 64 controls switching valves, not shown, and so on provided on the branch portions 55*b*, 57*b* shown in FIG. 7 to selectively adjust the flows of the air in the branch portions 55*b*, 57*b*.

Figure 9:
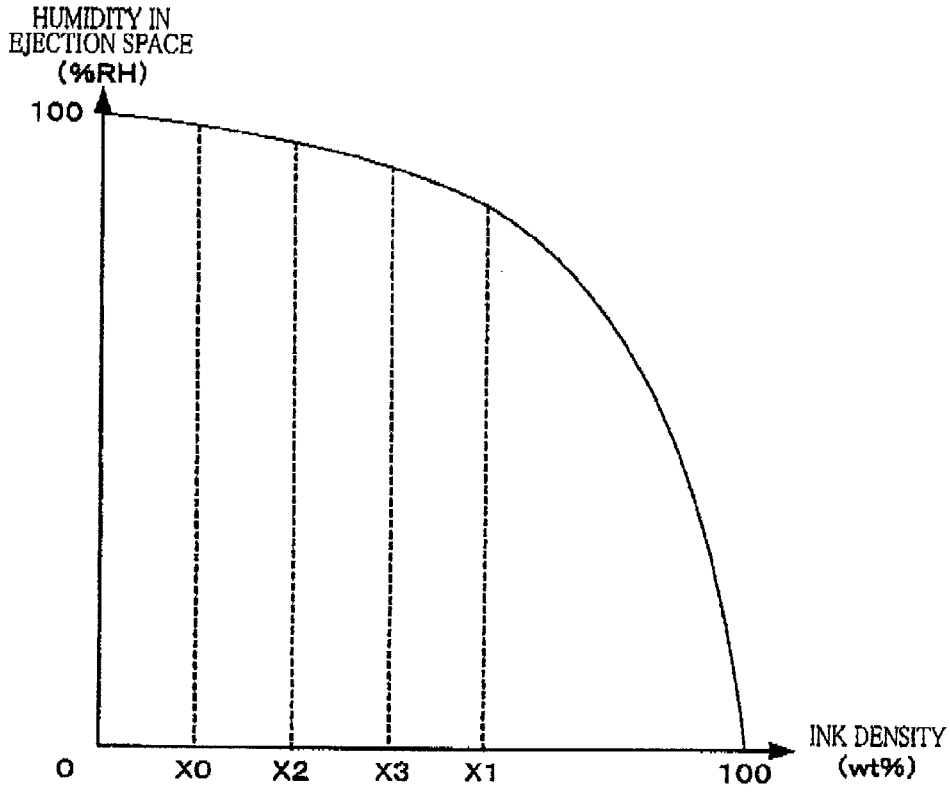
FIG. 9 is a graph showing a relationship between a density of ink ejected from the ink-jet head shown in FIG. 2 and humidity of an ejection space.

The supply of the humid air from the opening 51*b* into the ejection space S1 increases humidity in the ejection space S1. As shown in FIG. 9, the density of the ink in the ejection openings 14*a* lowers with an increase in the humidity in the ejection space S1. It is noted that FIG. 9 indicates a relationship between the humidity and the ink density in equilibrium. The maintenance controlling section 64 adjusts a length of time of the supply (supply time) of the humid air and an amount of the ink ejected in the flushing on the basis of (a) the remaining amount of the water stored in the water tank 54 which has been detected by the water-remaining-amount sensor 58 and (b) the remaining amount of the ink stored in the cartridge 39 which has been detected by the ink-remaining-amount sensor 39*a*.

Specifically, where the remaining amount of the water stored in the water tank 54 is equal to or larger than the first predetermined amount, the maintenance controlling section 64 determines the supply time of the humid air as "normal" independently of the remaining amount of the ink stored in the cartridge 39 such that the density of the ink in the ejection openings 14*a* becomes an ink density X2 that is equal to or higher than an appropriate density X0 allowing stable ejection of the ink from the ejection openings 14*a* (in an ideal state of the ink). In this case, the maintenance controlling section 64 may determine the supply time of the humid air such that the ink density becomes X2 that is equal to or lower than the appropriate density X0. It is noted that the humidity of the air discharged from the upper space of the water tank 54 is a humidity near 100%.

Where the remaining amount of the water stored in the water tank 54 is less than the first predetermined amount and equal to or greater than a second predetermined amount or value (the second predetermined amount<the first predetermined amount) and where the remaining amount of the ink stored in the cartridge 39 is equal to or greater than a third predetermined amount or value, the maintenance controlling section 64 determines the supply time of the humid air as "short" such that the density of the ink in the ejection openings 14*a* becomes an ink density X3 that is equal to or higher than the ink density X2. It is noted that "short" that is the length of time for supplying the humid air is shorter than "normal" that is the length of time for supplying the humid air, and an amount of the humid air to be supplied where the length of time for supplying the humid air is "short" is smaller than an amount of the humid air to be supplied where the length of time for supplying the humid air is "normal".

Where the remaining amount of the water stored in the water tank 54 is less than the second predetermined amount and where the remaining amount of the ink stored in the cartridge 39 is equal to or greater than the third predetermined amount, the maintenance controlling section 64 determines the supply time of the humid air as "0" for preventing the humid air from flowing into the ejection space S1. In this determination, the density of the ink in the ejection openings 14*a* is an ink density X1 that is equal to or higher than the ink density X3.

Further, where the remaining amount of the ink stored in the cartridge 39 is less than the third predetermined amount, the maintenance controlling section 64 determines the supply time of the humid air as "normal" independently of the remaining amount of the water stored in the water tank 54. The maintenance controlling section 64 then drives the pump 53 on the basis of the determined supply time. It is noted that, when a forced humidification command is inputted by the user via the touch panel 47 or when a predetermined length of time has passed from a point in time when the ejection spaces S1 are sealed to establish the capped state (which will be described below), the maintenance controlling section 64 determines the supply time of the humid air as "normal" independently of the remaining amount of the water stored in the water tank 54 and drives the pump 53 on the basis of the determined supply time.

The maintenance controlling section 64 then determines an ejection amount of the ink in the flushing to be performed later, for each of the ejection openings 14*a*. Where the supply time of the humid air is the above-described "normal", the ejection amount of the ink is determined at an amount corresponding to a low density ink whose ink density is lower than the appropriate density X0. Where the supply time of the humid air is the above-described "short" or "0", the ejection amount of the ink is determined at an amount corresponding to a high density ink whose ink density is higher than the appropriate density X0. Here, the ejection amount of the ink in the flushing is set so as to have the following relationship: the ink ejection amount where the supply time of the humid air is "normal"<the ink ejection amount where the supply time of the humid air is "short"<the ink ejection amount where the supply time of the humid air is "0". The maintenance controlling section 64 calculates an ink amount of the low density ink or the high density ink on the basis of the determined supply time of the humid air and determines the obtained ink amount as the ejection amount of the ink in the flushing. It is noted that, as described above, where the supply time is determined such that the ink density becomes X2 that is equal to or lower than the appropriate density X0 when the remaining amount of the water stored in the water tank 54 is equal to or larger than the first predetermined amount, the amount of the ink to be ejected in the flushing is determined as an amount corresponding to the low density ink whose ink density is lower than the appropriate density X0. It is noted that, where the supply time of the humid air is "normal", the amount of the ink to be ejected in the flushing may be determined as an amount corresponding to the high density ink whose ink density is higher than the appropriate density X0.

A viscosity of the ink in each ejection opening 14*a* increases due to drying with the longer elapsed time from the last ejection of the ink. Where the ink in each ejection opening 14*a* has a relatively high viscosity, the volume of the high density ink is large. The maintenance controlling section 64 refers to the ejection-history storage section 63 to further correct the ejection amount of the ink for the flushing, which ejection amount has been determined for each ejection opening 14*a* so as to increase with the longer elapsed time.

Further, the maintenance controlling section 64 corrects the ejection amount of the ink in the flushing on the basis of the remaining amount of the ink stored in the cartridge 39. Specifically, where the remaining amount of the ink stored in the cartridge 39 is less than the third predetermined amount, the maintenance controlling section 64 corrects the determined ejection amount of the ink in the flushing such that the ejection amount of the ink becomes the amount corresponding to the supply time of the humid air, "normal".

The maintenance controlling section 64 then controls the head 10 via the head controlling section 62 such that the corrected amount of the ink is ejected or discharged from each ejection opening 14*a* in the flushing. The ink ejected from the ejection openings 14*a* in the flushing is attached or landed on the support face 8*a*. The ink landed on the support face 8*a* is cleaned by a cleaning mechanism, not shown.

When the flushing is finished, the maintenance controlling section 64 rotates the gears 43 to move the movable member 42 upward, thereby moving the projecting portion 41*a* from the contact position to the distant position. As a result, a capping state of the caps 40 is changed from the capped state to the uncapped state, thereby establishing a recordable state, and the humidifying maintenance is completed. As thus described, in the present embodiment, the flushing is performed in the capped state in order to prevent the ink droplets from spreading or being splashed, but the flushing may be performed in the uncapped state. When the state of the printer 1 is changed to the standby state or the sleep state after the completion of the recording, the maintenance controlling section 64 rotates the gears 43 to move the movable member 42 downward, thereby moving the projecting portion 41*a* from the distant position to the contact position. As a result, the capping state is changed to the capped state.

Figure 10:
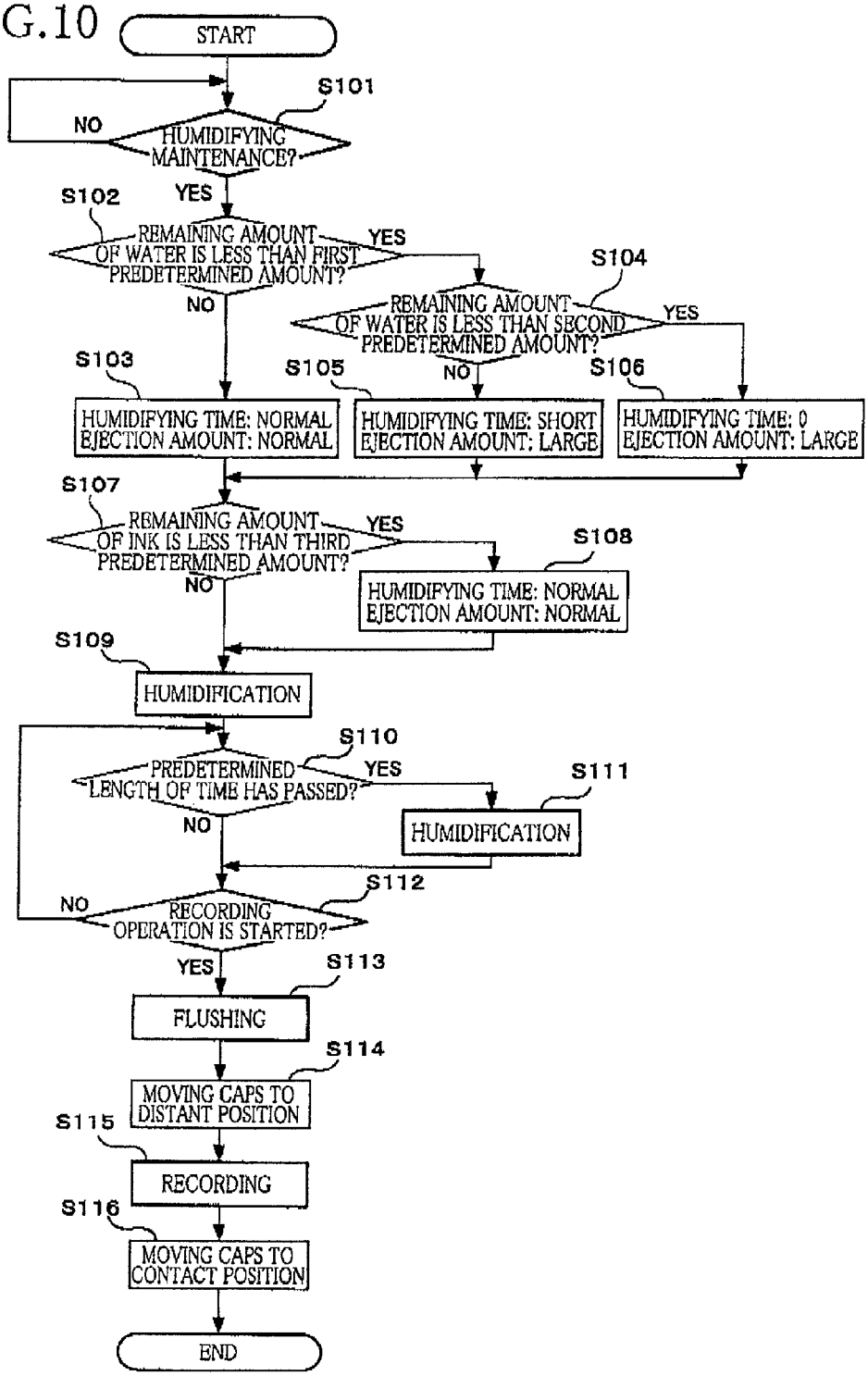
FIG. 10 is a flow-chart showing a recording operation of the printer in FIG. 1.
Figure 11:
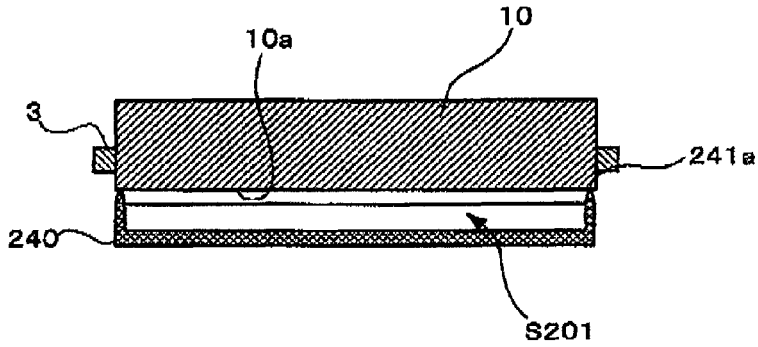
FIG. 11 is a view for explaining a modification of the present invention.

There will be next explained the recording operation of the printer 1 with reference to FIG. 10. As shown in FIG. 10, in S101, the maintenance controlling section 64 judges whether the humidifying maintenance is to be performed or not by judging whether or not the predetermined length of time has passed from the last recording in the standby state (in the capped state).

Where the maintenance controlling section 64 has judged that the humidifying maintenance is to be performed (S101: YES), the maintenance controlling section 64 judges in S102 whether the remaining amount of the water stored in the water tank 54 is less than the first predetermined amount or not. Where the maintenance controlling section 64 has judged that the remaining amount of the water is not less than the first predetermined amount (S102: NO), the Maintenance controlling section 64 determines in S103 the supply time of the humid air (humidifying time) as "normal". Further, the maintenance controlling section 64 determines the ejection amount of the ink in the flushing. In this case, the maintenance controlling section 64 does not correct the determined ejection amount of the ink in the flushing on the basis of the remaining amount of the ink stored in the cartridge 39 (the ejection amount: normal).

Where the maintenance controlling section 64 has judged that the remaining amount of the water is less than the first predetermined amount (S102: YES), the maintenance controlling section 64 judges in S104 whether the remaining amount of the water is less than the second predetermined amount or not. Where the maintenance controlling section 64 has judged that the remaining amount of the water is not less than the second predetermined amount (S104: NO), the maintenance controlling section 64 determines the supply time of the humid air as "short". Further, the maintenance controlling section 64 determines in S105 the ejection amount of the ink in the flushing. In this case, since the supply time of the humid air has been determined as "short", the maintenance controlling section 64 determines to increase the determined ejection amount of the ink in the flushing such that all the thickened ink (having a high viscosity) is discharged from each ejection opening 14*a* in the flushing. That is, the amount of the ink discharged in the flushing is set at an amount that is larger than the amount of the ink in the flushing where the supply amount of the humid air is determined as "normal".

Where the maintenance controlling section 64 has judged that the remaining amount of the water is less than the second predetermined amount (S104: YES), the maintenance controlling section 64 determines the supply time of the humid air as "0". Further, the maintenance controlling section 64 determines in S106 the ejection amount of the ink in the flushing. In this case, since the supply time of the humid air has been determined as "0", the maintenance controlling section 64 determines to increase the determined ejection amount of the ink in the flushing such that all the thickened ink (having a high viscosity) is discharged from each ejection opening 14*a* in the flushing. That is, the amount of the ink to be discharged in the flushing is set at an amount that is larger than the amount of the ink in the flushing where the supply amount of the humid air is determined as "normal". It is noted that the ejection amount determined in S106 is larger than the ejection amount determined in S105, i.e., the amount of the ink in the flushing where the supply amount of the humid air is determined as "short".

In S107, the maintenance controlling section 64 judges whether the remaining amount of the ink stored in the cartridge 39 is less than the third predetermined amount or not. Where the maintenance controlling section 64 has judged that the ink remaining amount is not less than the third predetermined amount (S107: NO), the maintenance controlling section 64 drives in S109 the pump 53 on the basis of the determined supply time. Where the maintenance controlling section 64 has judged that the ink remaining amount is less than the third predetermined amount (S107: YES), the maintenance controlling section 64 in S108 determines the supply time of the humid air as "normal" and corrects the determined ejection amount of the ink in the flushing as normal, that is, the ejection amount is returned to its original amount by canceling the corrections determined in S105 and S106 in order to minimize the ejection amount of the ink in the flushing with a high priority given to saving the ink. Then in S109, the maintenance controlling section 64 drives the pump 53 on the basis of the determined supply time.

By driving the pump 53, the maintenance controlling section 64 sucks the air in each ejection space S1 from the opening 51*a* of the corresponding joint 51 and supplies the humidified air from the opening 51*b* into the ejection space S1. As a result, the ejection spaces S1 are humidified.

Then, where a relatively long time (the predetermined length of time) has passed without start of the recording (S110: YES), the humidity in the ejection space S1 is lowered (specifically, the humidity in the ejection space S1 becomes near the humidity of the outside space S2 due to dissipation of the air to the outside space S2 through the elastic member 41 and a leakage of the air from the cap 40). Thus, in S111, the maintenance controlling section 64 drives the pump 53 again. This supply time of the humid air may be the above-determined time (in S103-S105) and may be a time corresponding to "normal" or "short".

Then, where the recording operation is started on the basis of a recording command (S112: YES), the maintenance controlling section 64 controls in S113 the head 10 via the head controlling section 62 such that the determined amount of the ink is ejected in the flushing.

Then in S114, when the flushing is finished, the maintenance controlling section 64 moves the projecting portion 41*a* from the contact position to the distant position to change the capping state from the capped state to the uncapped state. As a result, the humidifying maintenance is completed. Then in S115, the recording operation is performed on the sheet P. Where the recording on all the sheets P is completed, the maintenance controlling section 64 in S116 moves the projecting portion 41*a* from the distant position to the contact position to change the capping state from the uncapped state to the capped state (that is, the cap 40 is brought into contact with the support face 8*a*). When the change to the capped state is completed, the state of the printer 1 is changed to the standby state, and the processing indicated by the flowchart in FIG. 10 is completed.

As explained above, in the printer 1 as the present embodiment, where the remaining amount of the water becomes less than the first predetermined amount, a consumption of the water is reduced by decreasing the amount of the humid air to be supplied into the ejection spaces S1 (that is, by shortening the supply time of the humid air), and the amount of the ink to be discharged in the flushing is increased. Thus, it is possible to lengthen a period in which the ink can be discharged from the ejection openings 14*a* after the humidified air is supplied into the ejection spaces S1. This makes it possible to reduce the consumption of the water while restraining the increase in viscosity of the ink in the ejection openings 14*a*.

Further, when the remaining amount of the water is less than the second predetermined amount, the humid air is not supplied into the ejection spaces S1. Thus, in a situation given a higher priority than a situation in which the printer 1 is in an off-state for a relatively long time, for example, the humid air can be supplied to the ejection spaces S1.

Further, when the forced humidification command is inputted by the user via the touch panel 47, the humid air can be supplied into the ejection space S1 independently of the remaining amount of the water. This makes it possible to forcibly humidify the air in the ejection spaces S1 as needed.

Further, the amount of the humid air supplied into the ejection spaces S1 in the case where the remaining amount of the water is less than the first predetermined amount and where the ink remaining amount is less than the third predetermined amount is the same as that in the case where the remaining amount of the water is equal to or greater than the first predetermined amount and where the ink remaining amount is equal to or greater than the third predetermined amount. Thus, the ink can be used for the recording with a higher priority.

Further, the humid air is supplied into the ejection spaces S1 each time when the predetermined length of time has passed from the change of the ejection spaces S1 to the sealed state. Thus, even where the recording is not performed for a relatively long time, it is possible to prevent the viscosity of the ink in the ejection openings 14*a* from increasing.

Further, when the remaining amount of the water becomes less than the first predetermined amount, the supply time of the humid air is shortened such that the density of the ink in the ejection openings 14*a* is higher than the appropriate density, making it possible to reliably reduce the consumption of the water.

Further, when the remaining amount of the water becomes less than the first predetermined amount, this information is displayed on the touch panel 47. Thus, the user can realize that the remaining amount of the water is small.

While the embodiment of the present invention has been described above, it is to be understood that the invention is not limited to the details of the illustrated embodiment, but may be embodied with various changes and modifications, which may occur to those skilled in the art, without departing from the spirit and scope of the invention.

In the above-described embodiment, where the remaining amount of the water is less than the second predetermined amount, the humid air is not supplied into the ejection spaces S1, but the humid air may be supplied into the ejection spaces S1 until the remaining amount of the water becomes zero. In this case, where the remaining amount of the water detected by the water-remaining-amount sensor 58 is less than the second predetermined amount, the maintenance controlling section 64 preferably execute the control such that the amount of the humid air to be supplied into the ejection space S1 in the capped state becomes small in comparison with the amount of the humid air in the case where the remaining amount of the water detected by the water-remaining-amount sensor 58 is equal to or larger than the second predetermined amount.

Further, in the above-described embodiment, when the forced humidification command is inputted by the user via the touch panel 47, the humid air is supplied into the ejection spaces S1 independently of the remaining amount of the water, but this printer 1 may be configured not to accept the forced humidification command.

Further, in the above-described embodiment, where the remaining amount of the water is less than the first predetermined amount, and the ink remaining amount is less than the third predetermined amount, the amount of the humid air to be supplied to the ejection spaces S1 is determined so as to be the same as that in the case where the remaining amount of the water is equal to or greater than the fast predetermined amount, but this printer 1 may be configured such that the amount of the humid air to be supplied to the ejection spaces S1 is not changed according to the ink remaining amount. Further, in the above-described embodiment, where the remaining amount of the water is less than the first predetermined amount and where the ink remaining amount is less than the third predetermined amount, the maintenance controlling section 64 executes the control such that the amount of the ink discharged from the ejection openings 14*a* in the sealed state becomes the same as that in the case where the remaining amount of the water is equal to or larger than the first predetermined amount, but the maintenance controlling section 64 may be configured not to change the amount of the ink discharged from the ejection openings 14*a* by depending on the ink remaining amount.

Further, in the above-described embodiment, the humid air is supplied into the ejection spaces S1 each time when the predetermined length of time has passed from the change of the ejection spaces S1 to the sealed state, but this printer 1 may be configured such that the humid air is not supplied even where the predetermined length of time has passed.

Further, in the above-described embodiment, where the remaining amount of the water is less than the fast predetermined amount, the supply time of the humid air is reduced such that the density of the ink in each ejection opening 14*a* is higher than the appropriate density, but this printer 1 may be configured such that the supply time of the humid air is reduced such that the density of the ink in each ejection opening 14*a* is not higher than the appropriate density.

Further, in the above-described embodiment, when the remaining amount of the water becomes less than the first predetermined amount, this information is displayed on the touch panel 47, but this printer 1 may be configured such that the information does not appear on the touch panel 47.

Further, the maintenance controlling section 64 is configured to determine and correct the ejection amount of the ink in the flushing for each ejection opening 14*a*, but the ejection amount of the ink in the flushing may be the same for all the ejection openings 14*a*. It is noted that, in the above-described embodiment, the maintenance controlling section 64 is configured to adjust the supply time of the humid air to adjust the amount of the humid air to be supplied into the ejection spaces S1 but may be configured to adjust the amount of the humid air to be supplied into the ejection spaces S1 by adjusting the number of the rotations of the pump 53 to adjust the supply amount of the humid air per unit time.

Further, in the humidifying maintenance, the air is circulated such that the air sucked through the openings 51*a* is supplied to the ejection spaces S1 through the openings 51*b*, but the humid air only needs to be supplied through the openings 51*b*. For example, the humid air may not be circulated.

Further, the projecting portion 41*a* is not limited to be movable as in the above-described embodiment. For example, the printer 1 may be configured such that the projecting portions are fixed to the head holder so as not to be movable, and the position of the distal ends of the respective projecting portions relative to the ejection face is constant. In this case, the position of the distal ends of the respective projecting portions relative to the ejection face can be changed by raising and lowering the head holder or the support face of the medium support portion, whereby the projecting portion can be selectively positioned at the contact position and the distant position.

Figure 12:
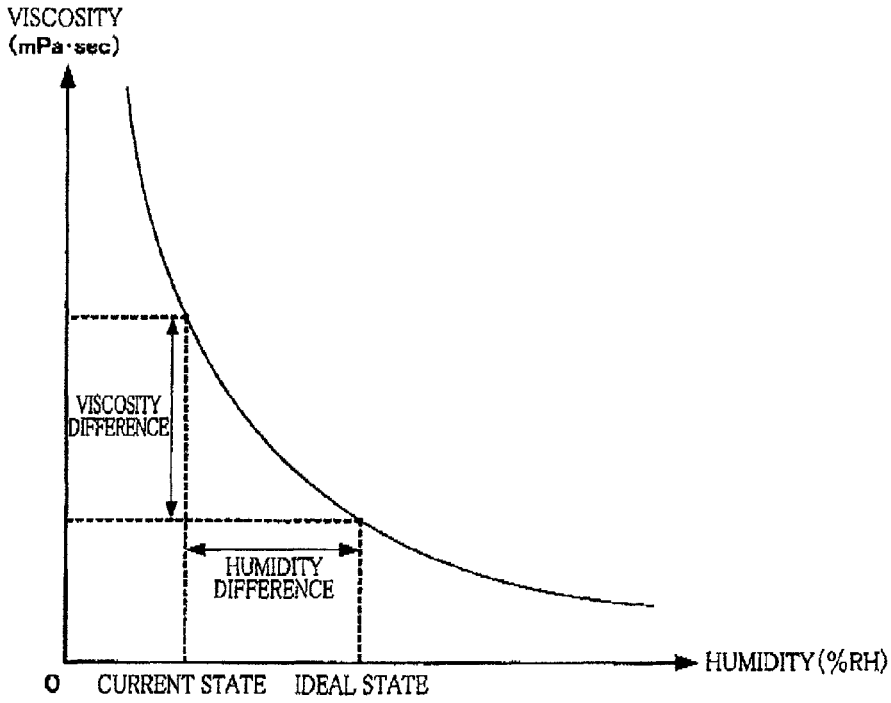
FIG. 12 is a graph showing a relationship between the humidity and a liquid viscosity in equilibrium.

Further, as shown in FIG. 12, a cap 240 may be formed independently of the head 10. In this case, the cap 240 is disposed at a position facing the ejection face 10*a* by a cap moving mechanism, not shown. The cap 240 can be selectively positioned at a contact position at which an end portion 241*a* of the cap 240 is held in contact with the ejection face 10*a* and a distant position at which the end portion 241*a* is distant from the ejection face 10*a* by raising or lowering at least one of the head 10 and the cap 240. When the cap 240 is located at the contact position, an ejection space S201 is sealed with the cap 240 (a capped state). When the cap 240 is located at the distant position, the ejection space S201 is not sealed (an uncapped state).

Further, a shape and a position of each of the openings of the one end and the other end of the circulation channel are not particularly limited as long as the opening is formed in the head or the head holder and opened in the ejection space. For example, the printer 1 may be configured such that one of the openings is formed in the head, and the other of the openings is formed in the head holder. The opening may be formed in the projecting portion. Further, the printer 1 may be configured such that each recessed portion 3*x* is not formed in the head or the face of the head holder, and the opening(s) of the one end and/or the other end of the circulation channel is formed at the same height level as that of the ejection face 10*a*. The openings may be formed at positions interposing (on opposite sides of) the ejection face 10*a* in the sub-scanning direction in plan view (in the case where the openings are formed in the head, the openings may be formed at positions interposing an ejection-opening group in the sub-scanning direction in plan view). Alternatively, the openings may be formed at positions not interposing the ejection face 10*a* (or the ejection-opening group) in plan view. That is, the openings may be formed on the same side of the ejection face 10*a* (or the ejection-opening group) in one direction.

Further, in the above-described embodiment, the maintenance controlling section 64 is configured to discharge the ink by the flushing, but the ink may be discharged by the purging.

Further, the flushing may be performed onto an additionally provided ink receiving member after the movement of the projecting portion 41*a* to the distant position (in S114 in FIG. 10) and before the recording (in S115).

The present invention is applicable to any of a line printer and a serial printer. Further, the application of the present invention is not limited to the printer, and the present invention is also applicable to devices such as a facsimile machine and a copying machine. Further, the present invention is also applicable to a device configured to eject liquid other than the ink.

What is claimed is:

1. A liquid ejection apparatus comprising:

a liquid-ejection head having a plurality of ejection openings and configured to eject image recording liquid through the ejection openings to record an image on a recording medium;

a sealing mechanism configured to selectively establish (i) a sealed state in which an ejection space in which the ejection openings are open is sealed from an outside and (ii) an unsealed state in which the ejection space is not sealed from the outside;

a humid-air supply mechanism including a humidification-liquid tank storing humidification liquid and configured to supply an air humidified by the humidification liquid into the ejection space;

a humidification-liquid detecting device configured to detect a remaining amount of the humidification liquid stored in the humidification-liquid tank;

a liquid-discharge portion configured to have the image recording liquid be discharged from the plurality of the ejection openings; and a controller configured to control the sealing mechanism, the humid-air supply mechanism, and the liquid-discharge portion, wherein the controller controls the humid-air supply mechanism to supply the humid air into the ejection space during the sealed state of the ejection space established by the sealing mechanism and then controls the liquid-discharge portion such that the image recording liquid is discharged from the plurality of the ejection openings prior to the ejection of the image recording liquid onto the recording medium for recording the image on the recording medium, and wherein, where the remaining amount of the humidification liquid detected by the humidification-liquid detecting device is less than a first predetermined value, the controller is configured to execute a control such that an amount of the humid air supplied into the ejection space in the sealed state and an amount of the image recording liquid discharged from the plurality of the ejection openings are respectively made small and large as compared with in a case where the remaining amount of the humidification liquid detected by the humidification-liquid detecting device is equal to or larger than the first predetermined value.

2. The liquid ejection apparatus according to claim 1, wherein, where the remaining amount of the humidification liquid detected by the humidification-liquid detecting device is less than a second predetermined value that is smaller than the first predetermined value, the controller executes a control such that the amount of the humid air supplied into the ejection space in the sealed state is made small as compared with an amount of the humid air in a case where the remaining amount of the humidification liquid detected by the humidification-liquid detecting device is equal to or larger than the second predetermined value.

3. The liquid ejection apparatus according to claim 1, wherein, where the remaining amount of the humidification liquid detected by the humidification-liquid detecting device is less than a second predetermined value that is smaller than the first predetermined value, the controller controls the humid-air supply mechanism such that the humid air is not supplied into the ejection space.

4. The liquid ejection apparatus according to claim 3, further comprising a humidification input portion configured to input a humidification command into the controller, wherein, when the humidification input portion has inputted the humidification command, the controller controls the humid-air supply mechanism such that the humid air is supplied into the ejection space even where the remaining amount of the humidification liquid detected by the humidification-liquid detecting device is less than the second predetermined value.

5. The liquid ejection apparatus according to claim 1, further comprising:

an image-recording-liquid tank storing the image recording liquid to be supplied to the liquid-ejection head; and an image-recording-liquid detecting device configured to detect a remaining amount of the image recording liquid stored in the image-recording-liquid tank, wherein the controller is configured to execute a control such that the amount of the humid air supplied into the ejection space in the sealed state in a case where the remaining amount of the humidification liquid detected by the humidification-liquid detecting device is less than the first predetermined value, and the remaining amount of the image recording liquid detected by the image-recording-liquid detecting device is less than a third predetermined value becomes the same as the amount of the humid air supplied into the ejection space in the sealed state in the case where the remaining amount of the humidification liquid detected by the humidification-liquid detecting device is equal to or larger than the first predetermined value.

6. The liquid ejection apparatus according to claim 5, wherein the controller is configured to execute a control such that the amount of the image recording liquid discharged from the plurality of the ejection openings in a case where the remaining amount of the humidification liquid detected by the humidification-liquid detecting device is less than the first predetermined value, and the remaining amount of the image recording liquid detected by the image-recording-liquid detecting device is less than a third predetermined value becomes the same as the amount of the image recording liquid discharged from the plurality of the ejection openings in the case where the remaining amount of the humidification liquid detected by the humidification-liquid detecting device is equal to or larger than the first predetermined value.

7. The liquid ejection apparatus according to claim 1, further comprising:

an image-recording-liquid tank storing the image recording liquid to be supplied to the liquid-ejection head; and an image-recording-liquid detecting device configured to detect a remaining amount of the image recording liquid stored in the image-recording-liquid tank, wherein the controller is configured to execute a control such that the amount of the humid air supplied into the ejection space in the sealed state in a case where the remaining amount of the humidification liquid detected by the humidification-liquid detecting device is less than the first predetermined value, and the remaining amount of the image recording liquid detected by the image-recording-liquid detecting device is less than a third predetermined value is made large as compared with the amount of the humid air supplied into the ejection space in the sealed state in a case where the remaining amount of the humidification liquid detected by the humidification-liquid detecting device is less than the first predetermined value, and the remaining amount of the image recording liquid detected by the image-recording-liquid detecting device is equal to or larger than the third predetermined value.

8. The liquid ejection apparatus according to claim 1, further comprising:

an image-recording-liquid tank storing the image recording liquid to be supplied to the liquid-ejection head; and an image-recording-liquid detecting device configured to detect a remaining amount of the image recording liquid stored in the image-recording-liquid tank, wherein the controller is configured to execute a control such that the amount of the image recording liquid discharged from the plurality of the ejection openings in a case where the remaining amount of the humidification liquid detected by the humidification-liquid detecting device is less than the first predetermined value, and the remaining amount of the image recording liquid detected by the image-recording-liquid detecting device is less than a third predetermined value is made small as compared with the amount of the image recording liquid discharged from the plurality of the ejection openings in a case where the remaining amount of the humidification liquid detected by the humidification-liquid detecting device is less than the first predetermined value, and the remaining amount of the image recording liquid detected by the image-recording-liquid detecting device is equal to or larger than the third predetermined value.

9. The liquid ejection apparatus according to claim 1, wherein the controller is configured to control the humid-air supply mechanism to supply the humid air into the ejection space each time when a predetermined length of time has passed from the change of the state of the ejection space to the sealed state.

10. The liquid ejection apparatus according to claim 1, wherein, when the remaining amount of the humidification liquid detected by the humidification-liquid detecting device becomes less than the first predetermined value, the controller reduces the amount of the humid air supplied into the ejection space such that a density of the image recording liquid in the plurality of the ejection openings becomes higher than an appropriate density in which the image recording liquid is stably ejected from the plurality of the ejection openings.

11. The liquid ejection apparatus according to claim 1, further comprising an informing portion configured to inform that the remaining amount of the humidification liquid detected by the humidification-liquid detecting device has become less than the first predetermined value.

12. The liquid ejection apparatus according to claim 1, wherein the controller is configured to adjust the amount of the humid air supplied into the ejection space in the sealed state by adjusting a length of time in which the humid-air supply mechanism supplies the humid air into the ejection space in the sealed state.

13. A nonvolatile storage medium storing computer-readable instructions to be executed by a liquid ejection apparatus, the liquid ejection apparatus comprising:

a liquid-ejection head having a plurality of ejection openings and configured to eject image recording liquid through the ejection openings to record an image on a recording medium;

a sealing mechanism configured to selectively establish (i) a sealed state in which an ejection space in which the ejection openings are open is sealed from an outside and (ii) an unsealed state in which the ejection space is not sealed from the outside;

a humid-air supply mechanism including a humidification-liquid tank storing humidification liquid and configured to supply an air humidified by the humidification liquid into the ejection space;

a humidification-liquid detecting device configured to detect a remaining amount of the humidification liquid stored in the humidification-liquid tank; and a liquid-discharge portion configured to have the image recording liquid be discharged from the plurality of the ejection openings, the computer-readable instructions, when executed by the liquid ejection apparatus, instructing the liquid ejection apparatus to perform steps comprising:

controlling, during the sealed state of the ejection space established by the sealing mechanism, the humid-air supply mechanism to supply the humid air into the ejection space, and then controlling the liquid-discharge portion such that the image recording liquid is discharged from the plurality of the ejection openings prior to the ejection of the image recording liquid onto the recording medium for recording the image on the recording medium; and executing, where the remaining amount of the humidification liquid detected by the humidification-liquid detecting device is less than a first predetermined value, a control such that an amount of the humid air supplied into the ejection space in the sealed state and an amount of the image recording liquid discharged from the plurality of the ejection openings are respectively made small and large as compared with in a case where the remaining amount of the humidification liquid detected by the humidification-liquid detecting device is equal to or larger than the first predetermined value.

* * * * *